United States Patent [19]

Creissels

[11] Patent Number: 5,060,576

[45] Date of Patent: Oct. 29, 1991

[54] DETACHABLE CABLE-CAR

[76] Inventor: Denis Creissels, 1, Allée de la Piscine, F 38170 Corenc, France

[21] Appl. No.: 518,436

[22] Filed: May 2, 1990

[30] Foreign Application Priority Data

May 26, 1989 [FR] France ..... 89 07361

[51] Int. Cl.[5] ..... B16B 12/10

[52] U.S. Cl. ..... 104/178; 104/189; 104/192; 104/197

[58] Field of Search ..... 104/112, 173.1, 178, 104/180, 182, 184, 185, 186, 189, 192, 197, 198

[56] References Cited

U.S. PATENT DOCUMENTS

| | | | |
|---|---|---|---|
| 3,605,630 | 9/1971 | Tsuruzawa | 104/178 |
| 4,833,997 | 5/1989 | Cathiard | 104/192 |

FOREIGN PATENT DOCUMENTS

| | | | |
|---|---|---|---|
| 0167232 | 7/1953 | Australia | 104/192 |
| 0263035 | 4/1988 | European Pat. Off. . | |
| 0285516 | 10/1988 | European Pat. Off. . | |
| 304749 | 8/1917 | Fed. Rep. of Germany . | |
| 0667430 | 10/1929 | France | 104/178 |
| 910354 | 11/1962 | United Kingdom . | |
| 920114 | 3/1963 | United Kingdom . | |

*Primary Examiner*—Robert J. Oberleitner
*Assistant Examiner*—Mark T. Le
*Attorney, Agent, or Firm*—Parkhurst Wendel & Rossi

[57] ABSTRACT

A terminal of a detachable cable-car with two or more carrier-hauling ropes including bull-wheels located underneath the floor. After the cars have been uncoupled the carrier-hauling ropes run on downward diversion means which direct the ropes towards the bull-wheels. The cars detached from the ropes pass between the diversion wheels to the rear of the terminal.

6 Claims, 5 Drawing Sheets

DETACHABLE CABLE-CAR

BACKGROUND OF THE INVENTION

The invention relates to an aerial ropeway transport installation comprising two terminals, in which each rope runs on a bull-wheel to extend in a closed loop along an ascending track and a descending track, and cars capable of being coupled to at least two parallel carrier-hauling ropes moving in synchronism, and of being uncoupled from the ropes in the terminals to run on transfer tracks connecting the ascending and descending tracks, each car having a width smaller than, equal to or slightly greater than the distance between the two ropes in the entry and/or exit zone of the terminal after uncoupling and/or before recoupling of the car.

Detachable cable-cars with two or more endless-loop carrier-hauling ropes have in each terminal numerous rope guide sheaves and bull-wheels, which are relatively cumbersome. The bullwheels are generally located in the extension and at the height of the tracks, in the upper part of the terminal, at the place where the transfer and storage tracks on which the cars run uncoupled from the ropes are also located. It can be advantageous to divert the ropes to other locations to avoid any interference between the ropes and the cars or passengers in the terminal and to make the bull-wheels easier to house and/or to drive.

The object of the present invention is to achieve a terminal of simplified structure, wherein the bull-wheels are located underneath the floor supporting the passenger loading and unloading platforms.

SUMMARY OF THE INVENTION

The installation according to the invention is characterized in that the bull-wheel is located below the trajectory on which the cars run in the terminal and that rope diversion means arranged between the car uncoupling or coupling zone and the bull-wheel divert the rope downwards in the direction of the bull-wheel.

The bull-wheels can be drive and/or tension wheels and the drive or tension mechanisms are also removed to the lower part of the terminal, distinctly separated from the passenger movement zone. The diversion wheels or means are located at the entry to and exit from the terminal to divert the rope downwards as soon as the cars are uncoupled or just before they are recoupled at the exit from the terminal. In this zone the car doors are closed and there is no risk of the passengers taken on board coming into contact with the ropes or diversion wheels, which extend on both sides of the ar. The length of the terminal is only slightly increased if at all and the space made available by the ropes can be used for the car storage and transfer tracks.

Diverting the ropes downwards implies a distance between the ropes corresponding to the gauge of the cars and if this distance is lower on the line, the ropes merely have to be diverted laterally after the uncoupling zone and before the recoupling zone to achieve a sufficient distance apart. In an installation with two carrier-hauling ropes, forming two endless loopes, on which the cars are suspended on the line, each rope runs at the entry to and exit from the terminal on a diversion wheel with an axis transverse to the running direction of the ropes. The ropes, which extend before the diversion wheels in an appreciably horizontal plane, switch to running in a vertical or inclined plane or more exactly in two slightly offset planes, to enable the ropes to cross, and the bull-wheels are arranged in these vertical or inclined planes.

The rope guiding and return system, according to the invention presents a symmetry with respect to the vertical plane which contains the longitudinal axis of the terminal.

In the case where the distance between the ropes before they are diverted is greater than the width of the car, the two wheels or diversion means can be in separate vertical planes and be followed by guide sheaves which direct the ropes towards the bull-wheels. One of the diversion wheels, preferably the one located on the inside of the tracks, or both the diversion wheels can be slightly inclined so that they each extend in a face of a dihedron whose edge is oriented in the longitudinal direction of the ropes and above the latter. This incline automatically orients the rope transversely in the direction of the bull-wheel and avoids the need for or limits the number of additional guide sheaves. The arrangement at the exit from the terminal is naturally symmetrical to that at the entry.

When the distance between the ropes before they are diverted is roughly equal to or slightly smaller than the width of the car, an inclined arrangement of the diversion wheels causing the ropes to diverge enables the clearance passage of the cars to be increased. The rope diversion wheel extending on the outside of the track is preferably inclined as little as possible, in order not to offset the bull-wheel too far outwards on the far side of the other track. The inside diversion wheel is on the other hand sufficiently inclined to guide the rope onto the bull-wheel.

All the machinery and/or the rope tension system is located in the lower part of the terminal, which limits installation costs. The diameter of the bull-wheels can be smaller than the distance between the ascending side and the descending side of the corresponding rope and the difference is then compensated either by the incline of the diversion wheels or by additional guide sheaves.

According to a development of the invention, the distance between the ascending track and the descending track enables a central parking track to be arranged extending over the whole length of the terminal and passing between the two inside diversion wheels.

The invention can be applied to an installation with two carrier-hauling ropes moving in synchronism and whose distance apart corresponds appreciably to the width of the cars, but this distance apart can naturally be greater or much lower and in the latter case it suffices to increase their distance apart after the cars have been uncoupled and before they are diverted downwards, or at the exit from the terminal to decrease this distance apart between the diversion wheels and the coupling zone. The invention is also applicable to installations having carrier-hauling ropes offset heightwise with respect to one another or having more than two carrier-hauling ropes.

According to a development of the invention, the rope diversion means are sheave batteries which divert the ropes downwards according to an inclined trajectory running the ropes underneath the platforms where the bull-wheels are located extending in the inclined plane defined y the inclined trajectory of the ropes. The length of the terminal is only slightly increased for the inclined rope section to coincide with the car acceleration or deceleration section.

BRIEF DESCRIPTION OF THE DRAWINGS

Other advantages and features will become more clearly apparent from the following description of several illustrative embodiments of the invention, given as non-restrictive examples only and represented in the accompanying drawings, in which.

DESCRIPTION OF THE PREFERRED EMBODIMENT

Figure 1:
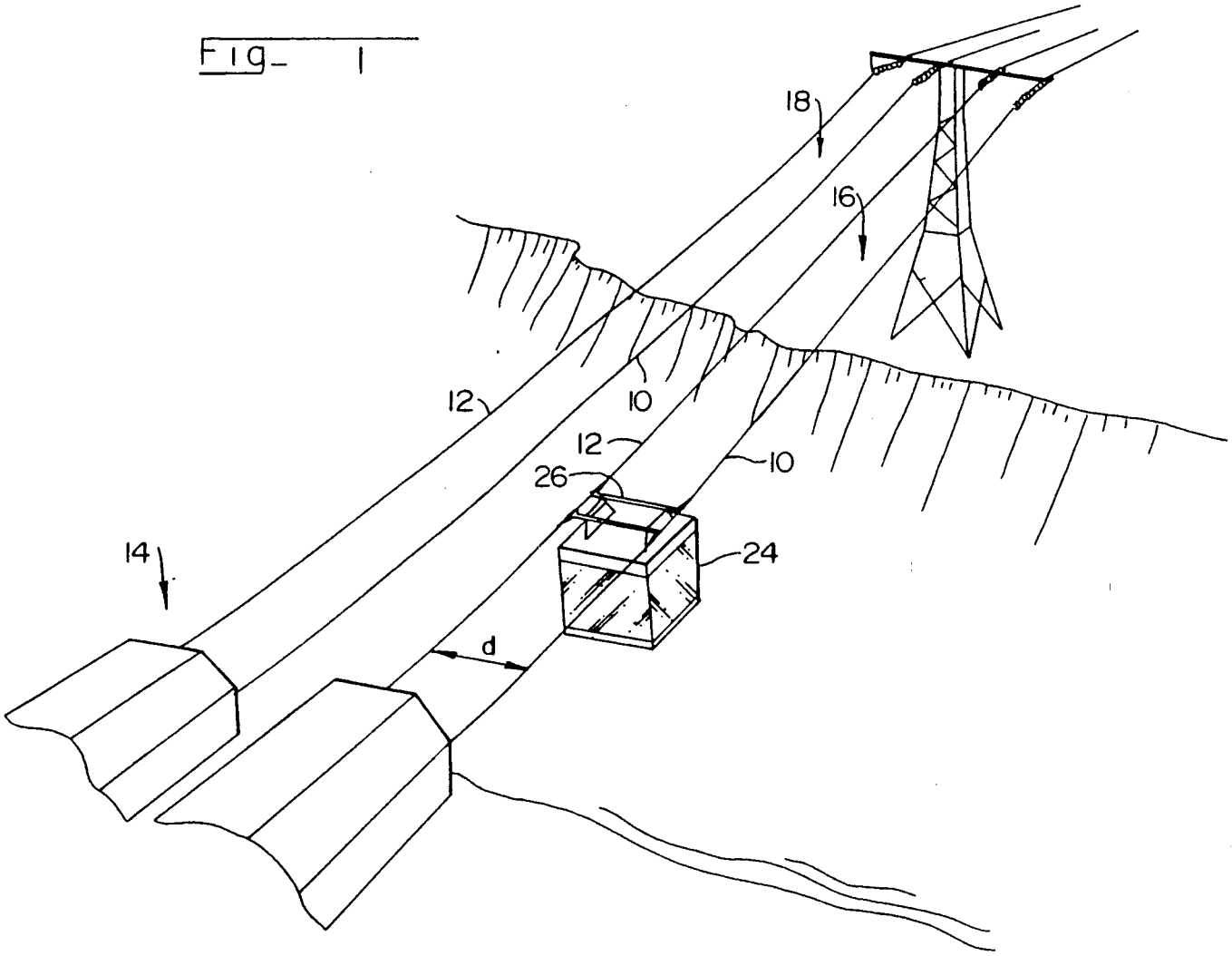
FIG. 1 is a schematic perspective view of an installation according to the invention.

In the figures, two carrier-hauling ropes 10, 12 of an aerial ropeway transport installation extend between two terminals only one 14 of which is represented. Each rope 10, 12 forms an endless loop extending along an ascending track 16 and a descending track 18 and passing in the stations on a bull-wheel 20, 22, which can be a drive wheel of the rope 10, 12 and/or a tension wheel. The two ropes 10, 12 are driven continuously in synchronism and in the example illustrated by the figures they are parallel at the same horizontal level. Cars 24 are coupled to the two ropes 10, 12 by a carriage 26 with detachable grips, several cars 24 being able to follow one another or be staggered along the ropes 10, 12. At the entry of a terminal 14, the cars 24 are uncoupled from the two ropes 10, 12 by opening of the coupling grips, are decelerated and taken over by transfer rail 28 passing in front of the loading and unloading platforms and driving the cars 24 to the opposite track. At the exit from the terminal, the cars are reaccelerated before being recoupled to the two ropes 10, 12. An installation of this kind, well-known to those specialized in this act, is for example described in the European Patent No. 93,690 which should be referred to for greater detail, notably on the advantages of the two carrier-hauling ropes.

Figure 2:
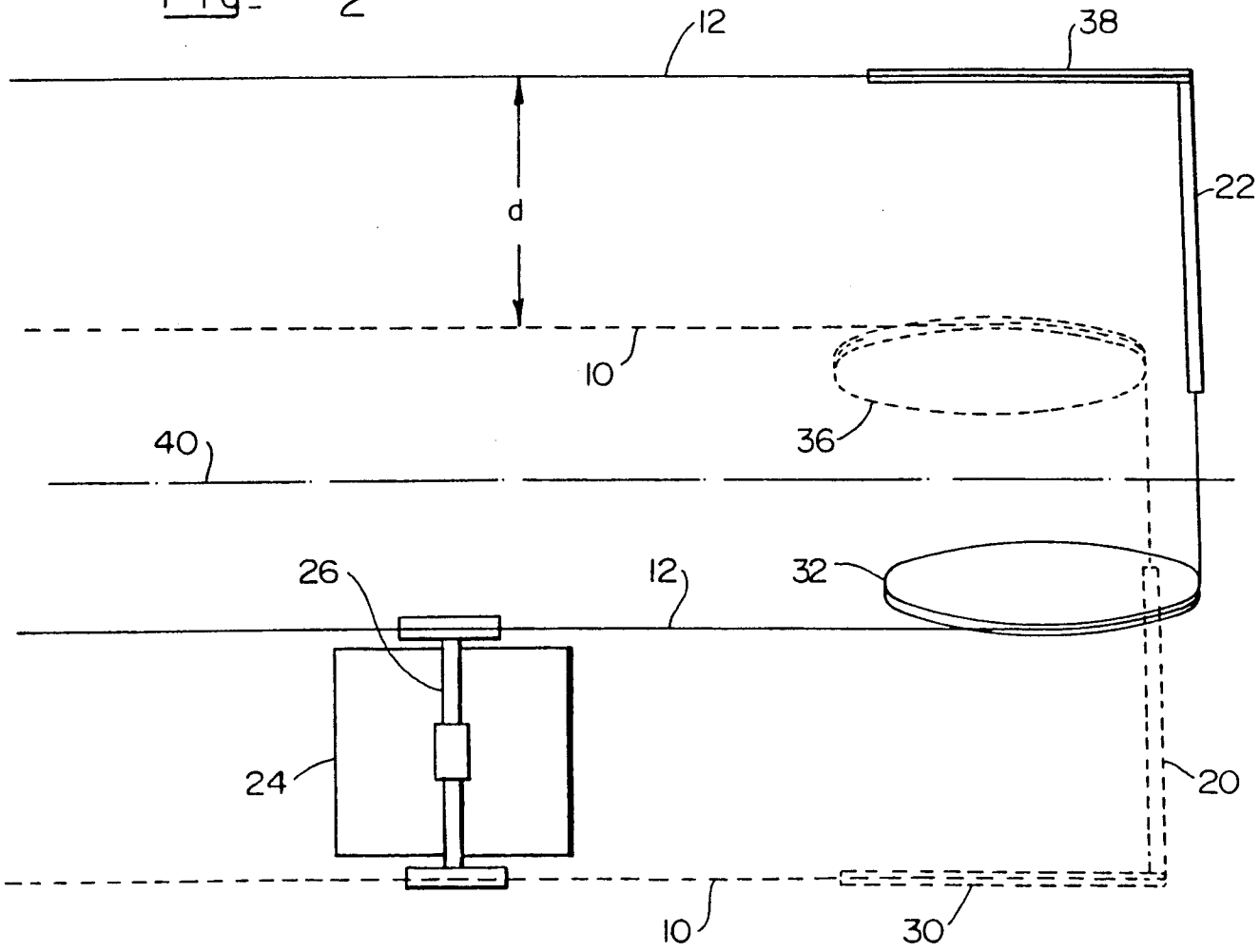
FIG. 2 is a plan view of the carrier-hauling rope system in a terminal of the installation according to FIG. 1.
Figure 4:
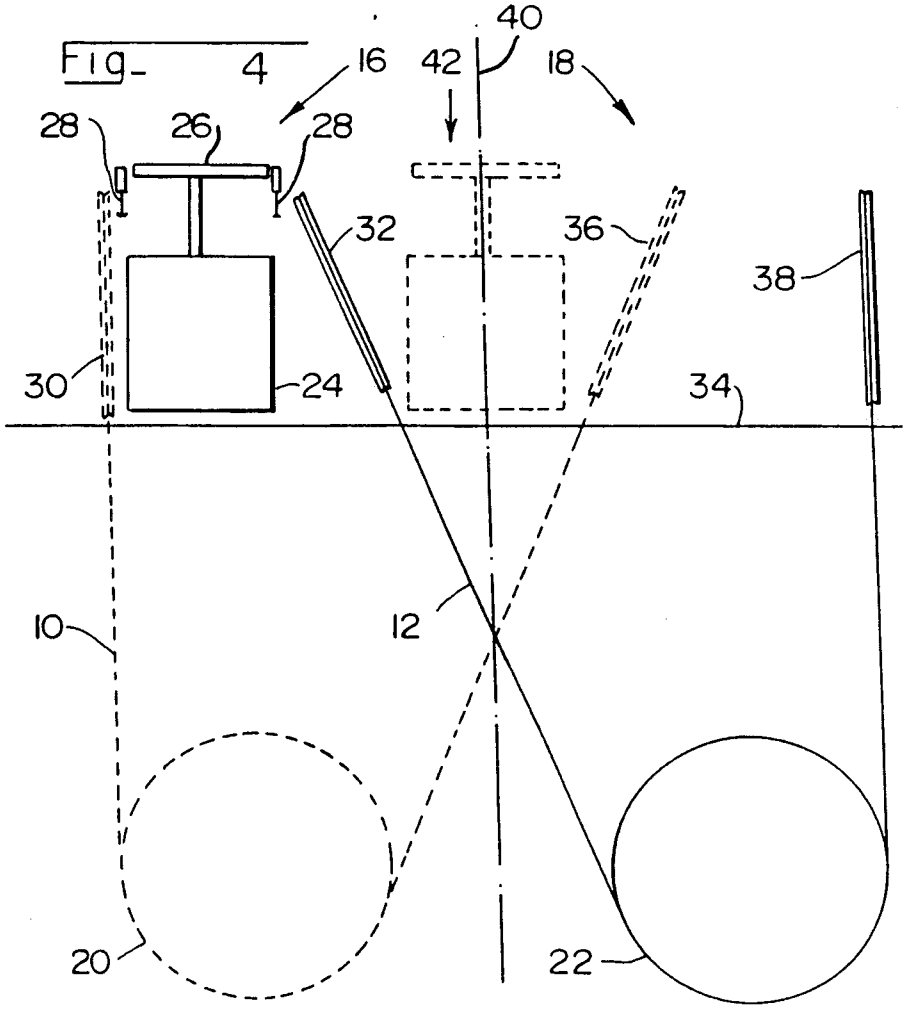
FIGS. 3 and 4 are elevational and side views of the system according to FIG. 2, respectively.
Figure 3:
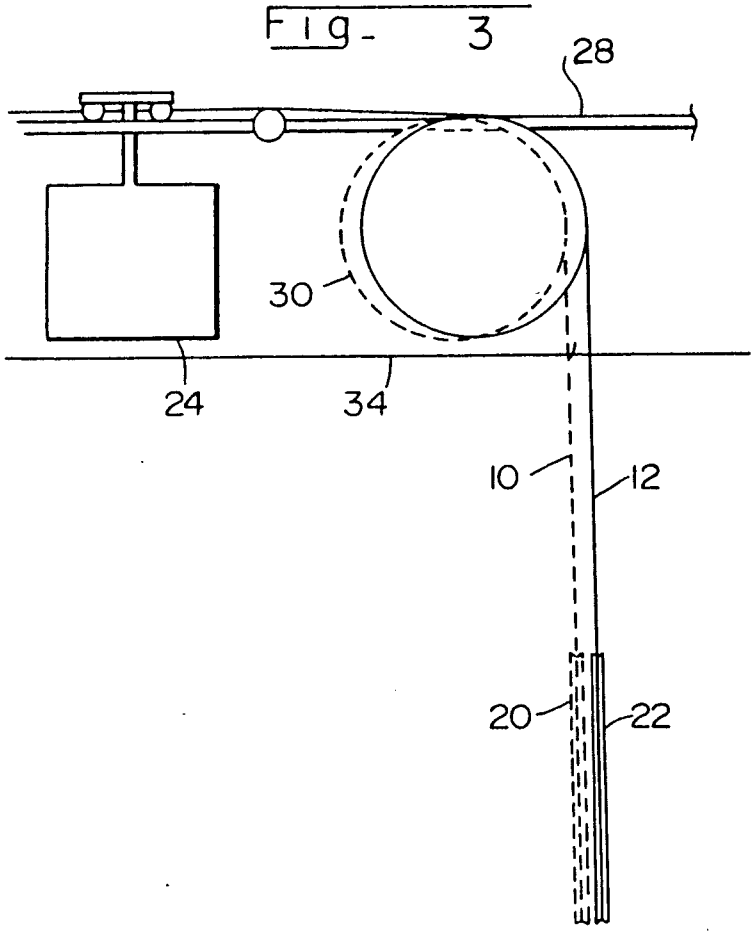

In FIGS. 2 to 4, a car 24 has just entered the terminal and its carriage 26 is already running on the transfer rail 28 while a control ramp (not shown) opens the coupling grips and uncouples the car 24 from the ropes 10, 12. The car 24 is decelerated by any appropriate means, for example by tyred braking wheels, and driven on the transfer track, notably by a driving chain, in a manner well-known in the art, to the unloading platform where the car doors open. At the exit from the uncoupling zone of the car 24, the ropes 10, 12 each pass over a diversion wheel 30, 32, which directs the rope downwards in the direction of the floor 34 of the terminal, passing through it to run on the corresponding bull-wheel 20, 22 before rejoining the opposite track where it again passes over a diversion wheel 36, 38, located before the recoupling zone of the car 24. The bull-wheels 20, 22, under the floor 34, have their horizontal axes oriented in the longitudinal direction of the terminal and the two bull-wheels 20, 22 are offset laterally with respect to one another and slightly in the longitudinal direction to enable the ropes 10, 12 to cross. The axes of the bull-wheels 20, 22 can be aligned, but the advantages of lateral offset will become apparent further on. The bull-wheels 20, 22 can be drive wheels and they are then driven by motors (not shown). They can be tension wheels and for this purpose by mobile.

The width of the car 24 represented in FIGS. 2 to 4 is smaller than the distance "d" between the ropes 10, 12 in the diversion zone, which is located after the uncoupling zone at the entry to the terminal, seen in the direction of movement of the car and before the recoupling zone a the exit from the terminal. This distance "d" can be the same on the line, but it can also be imposed by guide sheaves causing a lateral diversion of the ropes 10, 12 after the car 24 has been uncoupled. The diversion wheel 30, 38, located on the outside of the descending or ascending track, is vertical with an axis oriented transversely to the track to divert the rope through 90° and the relative bull-wheel 20, 22 is such that the rope 10, 12 extends linearly and vertically between the two wheels. The diversion wheel 32, 36, located on the inside of the tracks, is inclined laterally to divert the rope 10, 12 laterally and orient it towards the associated bull-wheel 20, 22. The distance between the diversion wheels 30, 32; 36, 38 opposite the passage of the car is greater than the distance "d" between the rope 10, 12 and enables the car to pass between the two diversion wheels to the rear part of the terminal (not shown) where the loading and unloading platforms and the passenger movement zones are situated. The doors of the car 24 are closed when the latter is not in this rear part and a barrier naturally separates this rear part from the front part where the ropes run 10, 12 run and the diversion wheels 30, 32; 36, 38 are located. The vertical position of the outside diversion wheels 30, 38 avoids any increase in the width of the terminal and enables the bull-wheels 20, 22 and their machinery to be arranged side by side.

By inclining the inside diversion wheels 32, 36, the diameter of the full-wheels 20, 22 can be smaller than the distance between the two tracks 16, 18 without the need for additional guide sheaves. It is clear that the inside diversion wheels 32, 36 can also be vertical, the rope 10, 12 then being guided towards the bull-wheels 20, 22 by guide sheaves (not shown). Similarly, then the bull-wheels 20, 22 are laterally offset with respect to the outside diversion wheels 30, 38, this offset can be compensated by guide sheaves. The rope system is completely symmetrical with respect to the longitudinal axis 40 of the terminal, and the outside rope of the ascending track becomes the inside rope of the descending track and vice-verse.

Diverting the ropes 10, 12 downwards under the floor 34 of the terminal clears the upper part of the terminal and in some installation, with sufficient distance between the ascending track 16 and descending track 18, a central storage track 42 can be housed, represented by the broken line in FIG. 4, extending over the whole length of the terminal, passing notably between the two inside diversion wheels 32, 36.

Figure 5:
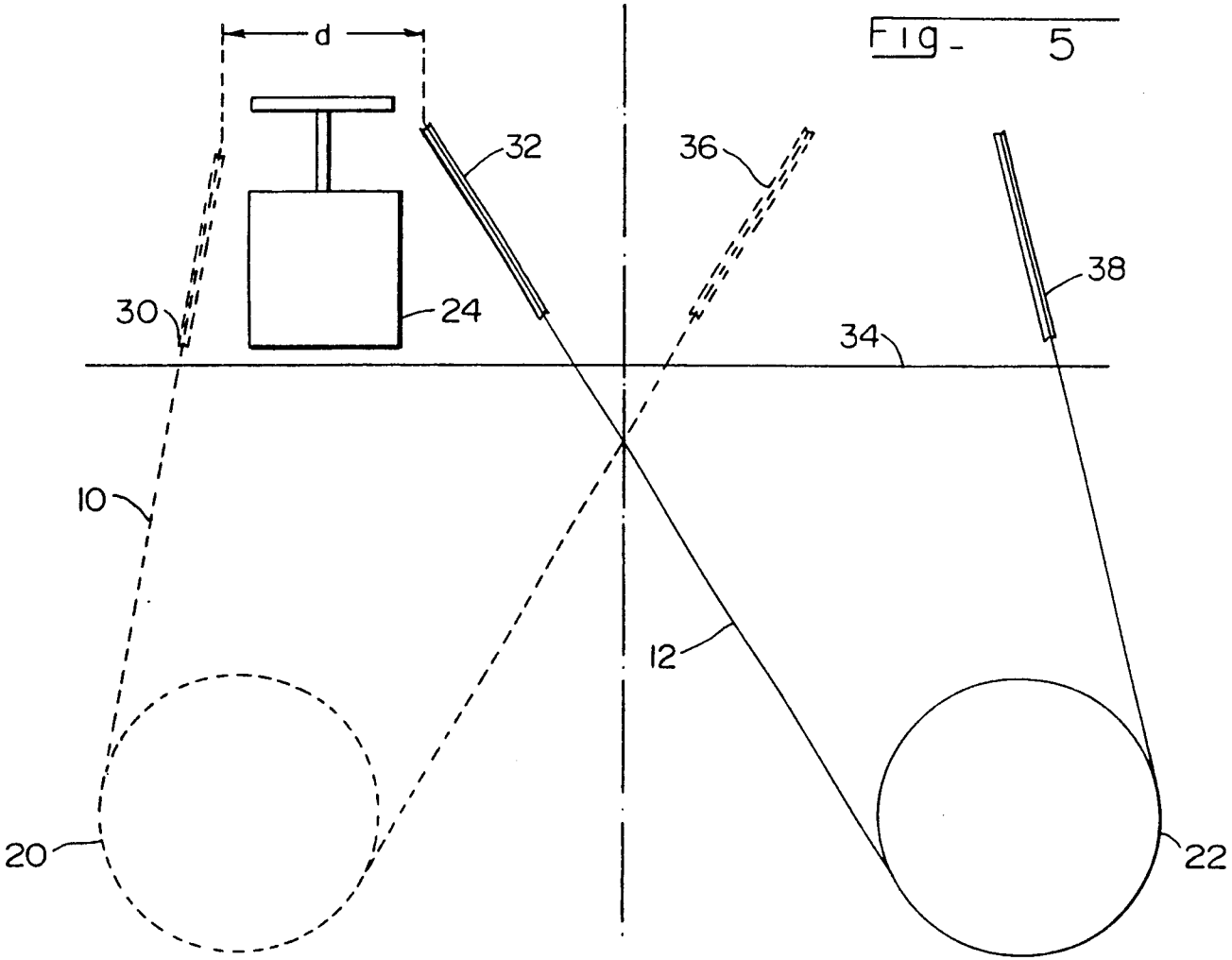
FIG. 5 is a similar view to that of FIG. 4, illustrating an alternative embodiment.

FIG. 5, similar to FIG. 4, illustrated an alternative embodiment, in which the same reference numbers are used to designate equivalent component parts. The distance "d" between the two ropes 10, 12 at the level of the diversion wheels 30, 32; 36, 38 is appreciably equal to or slightly less than the width of the car 24. The clearance for passage of the car 24 is increased by inclining the outside diversion wheels 30, 38 laterally, the two diversion wheels 30, 32; 36, 38 then being contained in the faces of a dihedron whose edge is located in the longitudinal direction of the ropes 10, 12 and above the latter. The bull-wheels 20, 22 are offset outwards by a corresponding value, but guide sheaves can be provided, avoiding this lateral offset. The incline of the outside diversion wheels 30, 38 is preferably as slight as possible.

Figure 7:
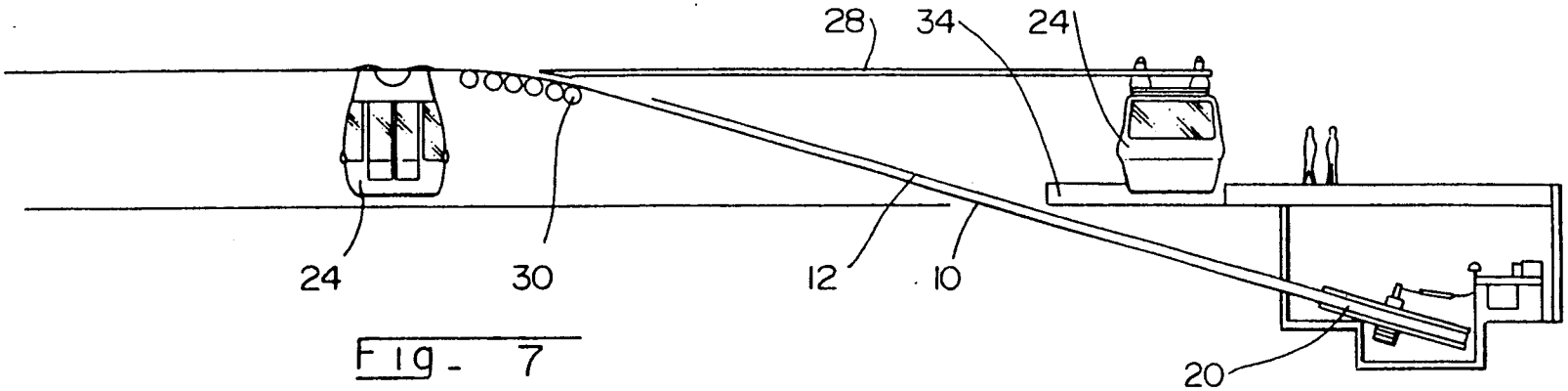
FIGS. 6 and 7 are similar views to those of FIGS. 2 and 3, illustrating another alternative embodiment.
Figure 6:
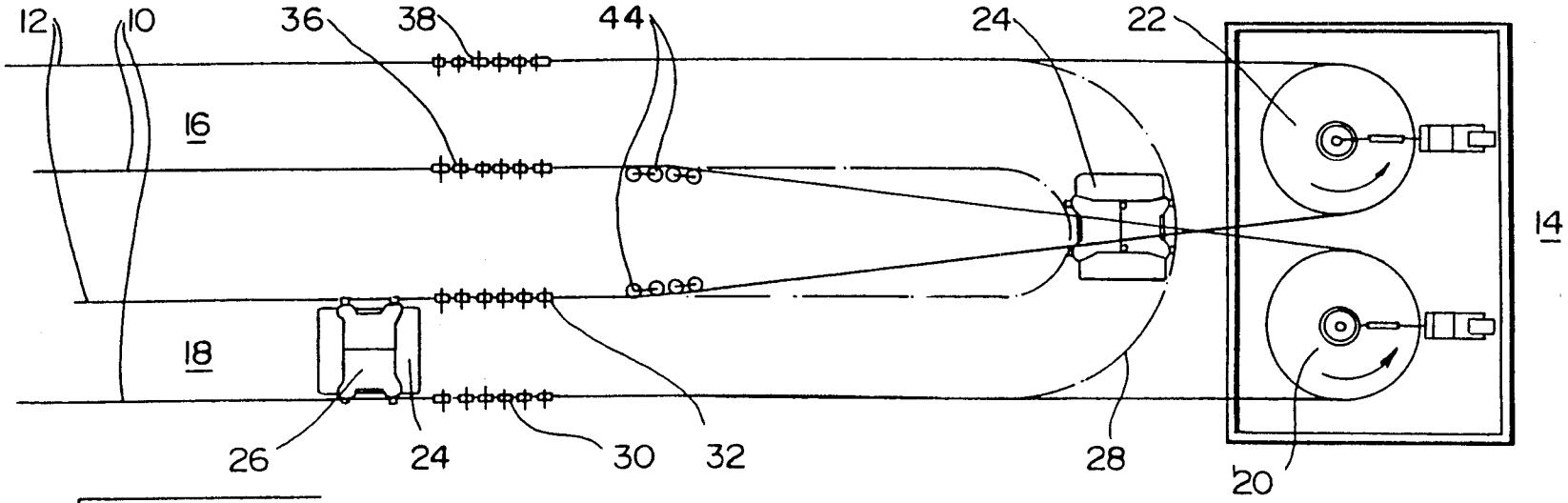

The alternative embodiment illustrated by FIGS. 6 and 7, in which the same reference numbers are used, comprises diversion sheave batteries 30, 32 which guide the ropes on an inclined trajectory under the floor 34 of the terminal where the bull-wheels 20, 22 are located with inclined axes to extend in the plane of the ropes 10, 12. When the diameter of the bull-wheels is smaller than the distance"d" between the ropes on the line, guide sheaves 44 causes the ropes to be diverted laterally.

The invention has been described in its preferred application with two carrier-hauling ropes and cars suspended from these ropes on the line. It is applicable to installations having a greater number of ropes, for example four, framing the car, or any other number.

I claim:

1. An aerial transport installation, comprising:

two terminals each having an entry and an exit;

a first track and a second track including a first and a second pair of carrier-hauling ropes, respectively, which extend in parallel and form two closed loops between said terminals;

passenger cars capable of being engaged between and coupled to said first pair of ropes and said second pair of ropes, and capable of being uncoupled from the carrier-hauling ropes when in said terminals;

uncoupling means disposed adjacent the entry of each of said terminals for uncoupling said cars from the carrier-hauling ropes;

recoupling means disposed adjacent the exit of each of said terminals for recoupling said cars to the carrier-hauling ropes;

platforms disposed in each of said terminals;

transfer tracks connecting said first track and said second track in each of said terminals, whereby said cars run on said transfer tracks and said platforms after being uncoupled from the carrier-hauling ropes;

a pair of bull-wheels located in each of said terminals below a running trajectory of said cars;

diverging means arranged between said uncoupling means and said bull-wheels for diverging the carrier-hauling ropes toward said bull-wheels;

converging means arranged between said recoupling means and said bull-wheels for converging the carrier-hauling ropes from said bull-wheels;

wherein a longitudinal symmetry axis exists between said first track and said second track at each of said terminals, and each bull-wheel is symmetrical to a corresponding bull-wheel in each said pair of bull-wheels with respect to a vertical plane containing said longitudinal axis, said bull-wheel and said corresponding bull-wheel being offset in a direction of the longitudinal axis to enable the carrier-hauling ropes to cross therebetween.

2. The installation of claim 1, wherein the carrier-hauling ropes of each said first pair of ropes and second pair of ropes are separated at the entry to and the exit from said terminals by a distance which is greater than a width of said cars, said diverging means and said converging means each comprising wheels located in two parallel vertical planes, and the installation planes comprising guide sheaves which cooperate with the carrier-hauling ropes to compensate for a difference between a diameter of said bull-wheels and a distance separating said first track and said second track.

3. The installation of claim 1, wherein the carrier-hauling ropes of each said first pair of ropes and said second pair of ropes are separated at the entry to and the exit from said terminals by a distance which is greater than a width of said cars, and wherein said diverging means and said converging means each comprise wheels, of which at least a wheel arranged on an inside track is inclined, for respectively diverging or converging the carrier-hauling ropes downward and sideways in a direction of said bull-wheels which have a smaller diameter than a distance separating said first track and said second track.

4. The installation of claim 1, wherein said diverging means and said converging means are formed by sheave batteries for respectively diverging or converging the carrier-hauling ropes on an inclined trajectory, and wherein said bull-wheels are located underneath the platforms in an inclined plane which contains said inclined trajectory of the carrier-hauling ropes.

5. The installation of claim 1, wherein the carrier-hauling ropes of each said first pair of ropes and said second pair of ropes are separated by a distance which is substantially equal to or smaller than a width of said cars, and wherein said diverging means and said converging means each comprises a pair of wheels which are inclined to form a dihedron having a parallel top edge defined above the carrier-hauling ropes and inclined sides defined y the carrier-hauling ropes for increasing a distance between the carrier-hauling ropes for said cars to pass through.

6. The installation of claim 5, wherein one wheel of each said pair of wheels located on an outside track is inclined only enough to allow said cars to pass, and a corresponding wheel located on an inside track is sufficiently inclined to guide the carrier-hauling ropes onto said bull-wheels.

* * * * *